US011079203B2

(12) United States Patent
Becker et al.

(10) Patent No.: US 11,079,203 B2
(45) Date of Patent: Aug. 3, 2021

(54) THREE-PIECE TACTICAL CUMMERBUND

(71) Applicant: AARDVARK, LaVerne, CA (US)

(72) Inventors: Jonathan B. Becker, Whittier, CA (US); Pei-hsuan Li, Whittier, CA (US)

(73) Assignee: AARDVARK, La Verne, CA (US)

( * ) Notice: Subject to any disclaimer, the term of this patent is extended or adjusted under 35 U.S.C. 154(b) by 248 days.

(21) Appl. No.: 16/362,199

(22) Filed: Mar. 22, 2019

(65) Prior Publication Data

US 2020/0300582 A1 Sep. 24, 2020

(51) Int. Cl.

| | |
|---|---|
| ***F41H 1/02*** | (2006.01) |
| ***A41D 13/00*** | (2006.01) |
| ***F41H 5/013*** | (2006.01) |
| ***A41D 13/05*** | (2006.01) |

(52) U.S. Cl.

CPC ..... *F41H 1/02* (2013.01); *A41D 13/0012* (2013.01); *A41D 13/0525* (2013.01); *F41H 5/013* (2013.01); *A41D 2300/32* (2013.01)

(58) Field of Classification Search

CPC ..... F41H 1/02; F41H 5/013; A41D 13/0012; A41D 13/0525; A41D 2300/32

USPC ..... 2/464

See application file for complete search history.

(56) References Cited

U.S. PATENT DOCUMENTS

| | | | | |
|---|---|---|---|---|
| 4,472,839 | A | 9/1984 | Johansen | |
| 4,990,115 | A | 2/1991 | Vorhauer et al. | |
| 5,173,969 | A | 12/1992 | Fredrickson | |
| 6,189,154 | B1 | 2/2001 | Ducharme | |
| D562,257 | S | 2/2008 | Beck | |
| 7,424,748 | B1 | 9/2008 | McDunn et al. | |
| 7,900,278 | B2 * | 3/2011 | Pittman | F41C 33/046 2/310 |
| 7,979,917 | B2 | 7/2011 | Osborne | |
| 7,987,523 | B2 | 8/2011 | Cole et al. | |
| 8,370,962 | B2 | 2/2013 | McBride et al. | |
| 8,490,212 | B1 * | 7/2013 | Asher | A41D 1/04 2/2.5 |
| 9,441,916 | B2 | 9/2016 | Seuk | |
| 9,565,922 | B2 | 2/2017 | Cole et al. | |
| 9,777,997 | B2 | 10/2017 | Swan et al. | |
| 9,901,127 | B2 | 2/2018 | LeMarbe | |
| 9,974,379 | B2 | 5/2018 | Cole et al. | |
| 10,051,948 | B2 | 8/2018 | Carver et al. | |
| 10,051,984 | B2 | 8/2018 | Buerck et al. | |
| 10,631,584 | B2 * | 4/2020 | LeMarbe | A41D 1/04 |
| 2004/0221361 | A1 | 11/2004 | D'Annunzio | |
| 2009/0136702 | A1 * | 5/2009 | Gu | F41H 5/04 428/49 |
| 2010/0152636 | A1 * | 6/2010 | Parks | F41H 1/02 602/19 |

(Continued)

*Primary Examiner* — Alissa L Hoey

(74) *Attorney, Agent, or Firm* — Vista IP Law Group LLP

(57) ABSTRACT

A tactical cummerbund for use with a tactical vest having a right, front vest connector and a left, front vest connector. The cummerbund includes an elastic connecting band and a protective right side portion and protective left side portion which connect to opposite ends of the connecting band. The connecting band may be positioned in the center of a channel in the back panel of the tactical vest such that it is protected from the elements. The connections of the right side portion and left side portion to the connecting band are adjustable to adjust the girth of the cummerbund.

22 Claims, 9 Drawing Sheets

(56) References Cited

U.S. PATENT DOCUMENTS

| | | | | |
|---|---|---|---|---|
| 2010/0287681 | A1* | 11/2010 | Storms, Jr. | F41H 1/02 2/102 |
| 2011/0023207 | A1* | 2/2011 | Storms, Jr. | A41D 1/04 2/102 |
| 2011/0094006 | A1 | 4/2011 | Cole et al. | |
| 2012/0084906 | A1 | 4/2012 | Sego, Jr. et al. | |
| 2012/0132066 | A1 | 5/2012 | Seuk | |
| 2013/0031698 | A1* | 2/2013 | Valles | A41D 1/08 2/221 |
| 2013/0061362 | A1* | 3/2013 | Crye | F41H 1/02 2/2.5 |
| 2013/0084764 | A1 | 4/2013 | Swan et al. | |
| 2014/0332572 | A1* | 11/2014 | Buerck | A44B 11/2596 223/111 |
| 2015/0342329 | A1* | 12/2015 | Formosa | A45F 3/08 224/666 |
| 2016/0202023 | A1* | 7/2016 | Osman | A41F 15/002 2/2.5 |
| 2016/0206019 | A1* | 7/2016 | Crye | F41H 1/02 |
| 2017/0199011 | A1* | 7/2017 | Beck | A41D 1/04 |
| 2019/0154404 | A1* | 5/2019 | LeMarbe | F41H 1/02 |
| 2019/0265005 | A1* | 8/2019 | Wellman | F41H 1/02 |
| 2019/0285387 | A1* | 9/2019 | Ballesteros Casas | F41H 5/013 |
| 2020/0166313 | A1* | 5/2020 | Cigard | F41H 1/02 |

* cited by examiner

THREE-PIECE TACTICAL CUMMERBUND

BACKGROUND

The field of the invention generally relates to tactical garments which provide body protection and means for carrying equipment, and more particularly, to an innovative three-piece, al cummerbund.

Tactical garments are protective clothing designed to protect the wearer from bodily injury from attacks and other hazards. Most tactical garments also include one or more systems and/or devices for carrying tactical gear such as flashlights, firearms, firearm magazines, holsters, ammunition, Tasers™, flash-bang devices, knives, rope, radios, medical gear, manuals, communication equipment, and/or other equipment. While tactical garments are most often used by military personnel, law enforcement, firefighters, paramedics, search and rescue personnel, security guards and body guards, they are also used by civilians such as hikers, and other outdoor adventurers.

Depending on the particular activity of the wearer, tactical garments may have body armor to protect from ballistics, such as bullets and explosive fragments. There are two main types of body armor: hard-plate body armor which can protect a wearer from very high energy ballistics such as rifle rounds; and soft (non-plated) body armor which can protect a wearer from handgun rounds and small explosive fragments.

The most common carrying systems used on most tactical garments are "PALS" and "MOLLS". PALS is a well-known acronym for "Pouch Attachment Ladder System." PALS comprises a pattern of straps attached to the garment, or slots disposed in the tactical garment, at intervals thereby forming a row or rows of webbing onto which corresponding straps for load load-bearing equipment (e.g., holsters, magazine pouches, radio pouches, knife sheathes, flashlight pouches, and other gear) are attached. The straps of the load-bearing equipment are interwoven between the webbing on each of two pieces and finally snapped into place, making for a very secure fit which can be detached with moderate effort. The term "MOLLS" is a well-known acronym for "Modular Lightweight Load-carrying Equipment" and refers to the load-bearing equipment which can be attached to the tactical garment using the PALS webbing. For a more detailed description of PALS webbing and MOLLE-compatible systems, see the Background section of U.S. Pat. No. 9,521,897, and see U.S. Pat. No. 5,724,707, referred to therein.

One of the most commonly known tactical garments is the protective vest. A previously disclosed tactical vest 100 is shown in FIGS. 1 and 2. Typically, the tactical vest 100 comprises two main panels, a front panel 102 which fits over the front torso of the wearer and a rear panel 104 which fits over the back of the wearer. The front panel 102 and rear panel 104 are connected to each other by shoulder straps 106 which fit onto the shoulders of the wearer to support the tactical vest 100. In many tactical vest designs, the sides of the front panel and rear panel are not directly attached to each other, such that the sides of the tactical vest are exposed.

In order to provide side protection, and also provide some flexibility and size adjustability to the tactical vest, a tactical cummerbund 110 may be utilized in combination with the tactical vest 100, as shown in FIGS. 1 and 2. The cummerbund 110 generally has the same armor and carrying system as the vest 100 to provide similar protection to the sides of the wearer. A typical, prior art, two piece tactical cummerbund 110 is shown in FIGS. 1-4. The two piece cummerbund

110 has a left side portion 112 which covers the left side of the wearer and a right side portion 114 which covers the right side of the wearer, as shown in FIGS. 1-4. Each side portion 112 and 114 has a front connecting device **116*l*, 116*r* on the front end of each side portion, such that the front end of each side portion connects to a mating connector 118*l*, 118*r* on the front panel of the vest 100. Each side portion 112 and 114 also has a rear connecting device 120*l*, 120*r* which connects the left side portion 112 to the right side portion 114 at the rear of the cummerbund 110. Alternatively, in some two piece cummerbunds, the rear ends of each side portion may connect to a respective mating connector on the rear panel 104 of the vest 100. The connecting devices 116*l*, 116*r*, 118*l*, 118*r* may be PALS connections, hook and loop fasteners ("hook and loop" as used herein means traditional hook and loop fasteners such as VELCRO™, as well as other similar touch fasteners such as 3M's DUAL LOCK™ fasteners), TUBES™ connectors (available from FirstSpear, LLC; see U.S. Pat. No. 10,051,984), or any other suitable connecting device. The connection of the cummerbund 110 to the front panel 102 and/or rear panel 104 may be adjustable in order to adjust the size of the cummerbund 110 to a particular wearer. For example, a PALS connection may be connected to a suitable one of the PALS webs to adjust the size of the cummerbund 110. Each of the side portions 112, 114 also includes a respective elastic band 122*l*, 122*r*. The elastic bands 122*l*, 122*r* provide some flexibility to the cummerbund 110 so that the cummerbund 110 in combination with the vest 100 is less constraining and more comfortable. The elastic bands 122*l*, 122*r* are positioned between the armored part of the respective side portions 112, 114 and the rear connection devices 120*l*, 120*r***.

However, the design of two piece tactical cummerbunds, such as cummerbund 110, has a number of drawbacks. For one, when installing the cummerbund 110 onto the vest 100 while wearing the vest 100, it can be difficult to center each of the left and right side portions 112, 114 so that the vest 100 and cummerbund 110 combination is centered on the torso of the wearer. For instance, if the connectors **116*l*, 116*r*, 118*l*, 118*r* on the left side portion 112 and right side portion 114 are not installed symmetrically on the vest 100 (i.e., at the same distance from the edges of the front panel 102 and rear panel 104 of the vest 100), then the cummerbund 110 will not be centered and the vest 100** will not be aligned on the wearer, which can make the tactical garments uncomfortable, and/or leave unprotected gaps in the armor (called "ballistic windows").

In addition, the most vulnerable parts of the cummerbund 110 to wear out are the elastic bands **122*l*, 122*r* of each side portion 112, 114. Because wearing the tactical garments (which are worn over the wearer's other clothing) provides another layer of insulation, the wearer typically perspires more than normally. Also, the tactical garments may be worn in wet weather, or in wet conditions, such that the cummerbunds get wet. Furthermore, the elastic bands 122*l*, 122*r* are positioned between the armored part and the rear connecting devices 120*l*, 120*r* such that the elastic bands 122*l*, 122*r* are more prone to be exposed to the elements, including sunlight and environmental conditions which degrade elastic materials. Although in some cases, the rear ends of the side portions 112, 114 are inserted into a channel of the rear panel 104 of the tactical vest 100 (as shown in FIG. 2), the elastic bands 122*l*, 122*r* may still be exposed because the elastic bands 122*l*, 122*r* are positioned between the armored part and the rear connecting device 120*l*, 120*r* of each side portion 112, 114**.

Accordingly, the elastic portions 122*l*, 122*r* of the cummerbund 110 tend to wear out much more quickly than the other fabric and armor elements. With the two-piece cummerbund, the entire side portion 112 or 114 must be replaced when the elastic portion 122*l*, 122*r* wears out. Moreover, in many cases, when one side portion 112 or 114 needs to be replaced, it is difficult to match the color of the other side portion due to fading and differing production batches, such that the wearer often times ends up replacing the entire cummerbund 110. This is expensive and wasteful.

Thus, there is a need for an improved tactical cummerbund which overcomes the deficiencies of previous designs.

SUMMARY

In one embodiment, the present invention is directed to an innovative, three piece tactical cummerbund for connection to, and use with, a tactical vest. For example, the tactical vest may be a typical tactical vest having a front panel which fits over the front torso of the wearer and a rear panel which fits over the back of the wearer. The front panel and rear panel are connected to each other by shoulder straps which fit onto the shoulders of the wearer to support the tactical vest, and the side of the front panel and rear panel are not directly attached to each other. The front panel has a right, front vest connector, and a left, front vest connector for attaching the three piece tactical cummerbund to the front panel.

The three piece tactical cummerbund comprises a right side portion, a left side portion, and a connecting band. The right side portion and left side portion are protective panels which fit over the sides of the wearer when the cummerbund is attached to the tactical vest and put on the wearer. The connecting band is configured to be positioned at the rear panel of the vest, and to connect to a respective back end of each of the right side portion and left side portion. In other words, a back end of each of the right side portion and left side portion connects to the connecting band at the back of the cummerbund.

The connecting band comprises an elastic band having a right end and a left end. A right connector is disposed on the right end of the elastic band and a left connector is disposed on the left end of the elastic band. The right and left connectors may be any suitable connector which is complementary to mating connectors on the back ends of the right side portion and left side portion, such as hook and loop fasteners, snaps, Molle-compatible straps, etc.

The right side portion comprises an elongated panel. The panel may be made out of any suitable fabric, textile, or sheet of material such as a polymer, and may include multiple layers of such materials. The panel may be flexible so that it can form around the contour of the side of the wearer's waist. In another aspect, the panel may include an armored panel for resisting ballistics. A front right connector is disposed on the front end of the panel (the end that extends around the front of the wearer), and is configured to releasably connect to the right, front vest connector. A rear right connector is disposed on the back end of the right side portion (the end that extends around the back of the wearer), and is configured to releasably connect to the right connector of the connecting band such that the right side portion extends from the right end of the connecting band.

The left side portion is a mirror image of the right side portion. Thus, the left side portion comprises an elongated panel which is the same or similar to the panel of the right side portion, and may also include an armored panel. A front left connector is disposed on a front end of the panel, and is configured to releasably connect to the left, front vest connector. A rear left connector is disposed on the back end of the left side portion, and is configured to releasably connect to the left connector of the connecting band such that the left side portion extends from the left end of the connecting band.

Accordingly, a three piece tactical cummerbund is disclosed which has significant advantages over previous two piece cummerbund designs. For one, the three piece cummerbund is easy to center when installing the cummerbund by simply attaching the right side portion and left side portion to the connecting band, positioning the connecting band in the center of the rear panel of the tactical vest, and then attaching the front right connector to the right, front vest connector and attaching the front left connect connector to the left, front vest connector. In another aspect, the connecting band may include a center connector centered on the elastic band which connects to a mating connector positioned at the middle of the rear panel of the tactical vest. In this way, the middle of the connecting band can be connected to the middle of the rear panel, thereby ensuring that the cummerbund is properly centered on the wearer.

Additionally, the elastic band of the connecting band is located in the middle of the cummerbund, between the connections to the right side portion and left side portion. In this position, when the rear of the cummerbund is inserted into a channel of the rear panel of the tactical vest, the elastic band is centered within the channel such that it is completely enclosed and protected within the channel. Therefore, the elastic band will last longer than the elastic bands of prior two piece designs.

Moreover, when the elastic band of the connecting band does wear out, or otherwise needs replacing, only the connecting band needs to be replaced. The protective portions of the cummerbund, i.e., the right side portion and left side portion, do not need to be replaced when the elastic band needs replacing. Since the connecting band is not armored, it is the cheapest part of the assembly, and therefore, repairing the elastic band of the three piece cummerbund is more cost effective than with previous two piece designs.

In another aspect of the three piece tactical cummerbund, the connection between the right connector of the connecting band and the rear right connector of the right side portion is adjustable to adjust the overall length of the cummerbund (also referred to as "girth" which, as used herein, means the measurement of the cummerbund when curved around a wearer's waist when worn by a wearer), and the connection between the left connector of the connecting band and the rear left connector of the left side portion is adjustable to adjust the overall length of the cummerbund. This may be accomplished using complementary hook and loop fasteners, PALS and MOLLE connectors, or other suitable adjustable connection devices. In one aspect, the right connector of the elastic band and the rear right connector are complementary hook and loop fasteners, and the left connector of the elastic band and the rear left connector are complementary hook and loop fasteners.

In still another feature of the three piece tactical cummerbund, the panels of the right side portion and left side portion may include a pocket covering substantially the entire area of the panel for inserting ballistic armor. The pocket can be formed from two layers of material forming the panel which are attached to each other around the perimeter of the layers to form the pocket. One side of the pocket may be left unattached to form an opening to insert ballistic armor, and a closure, such as a flap having a hook and loop fastener may be disposed at the opening to close the opening.

In still another feature, the cummerbund may include respective ballistic panels inserted into the pockets of the right side portion and left side portion. The ballistic panels may be soft armor or plated armor, depending on the particular application of the tactical cummerbund.

In yet another aspect, the right side portion and left side portion may have an outside cover having a PALS surface for attaching MOLLE-compatible devices to the cummerbund.

In still another feature of the tactical cummerbund the right, front vest connector and front right connector are complementary tube-style connectors and the left, front vest connector and front left connector are complementary tube-style connectors. As used herein, the term "tube-style connectors" refers to TUBES™ connectors (available from FirstSpear, LLC; see U.S. Pat. No. 10,051984), or similar connectors in which one connector has a channel and the complementary connector has a pin/tube which releasably locks into the channel.

In still another aspect of the tactical cummerbund, the right connector of the elastic band and the rear right connector comprise a complementary alligator style hook and loop fastener, and the left connector of the elastic band and the rear left connector comprise a complementary alligator style hook and loop fastener.

In another embodiment, the present invention is directed to the combination of the tactical vest and the three piece tactical cummerbund. The combination may comprise the cummerbund attached to the tactical vest either on or off a wearer, or the cummerbund in a kit with the tactical vest.

DETAILED DESCRIPTION

Figure 10:
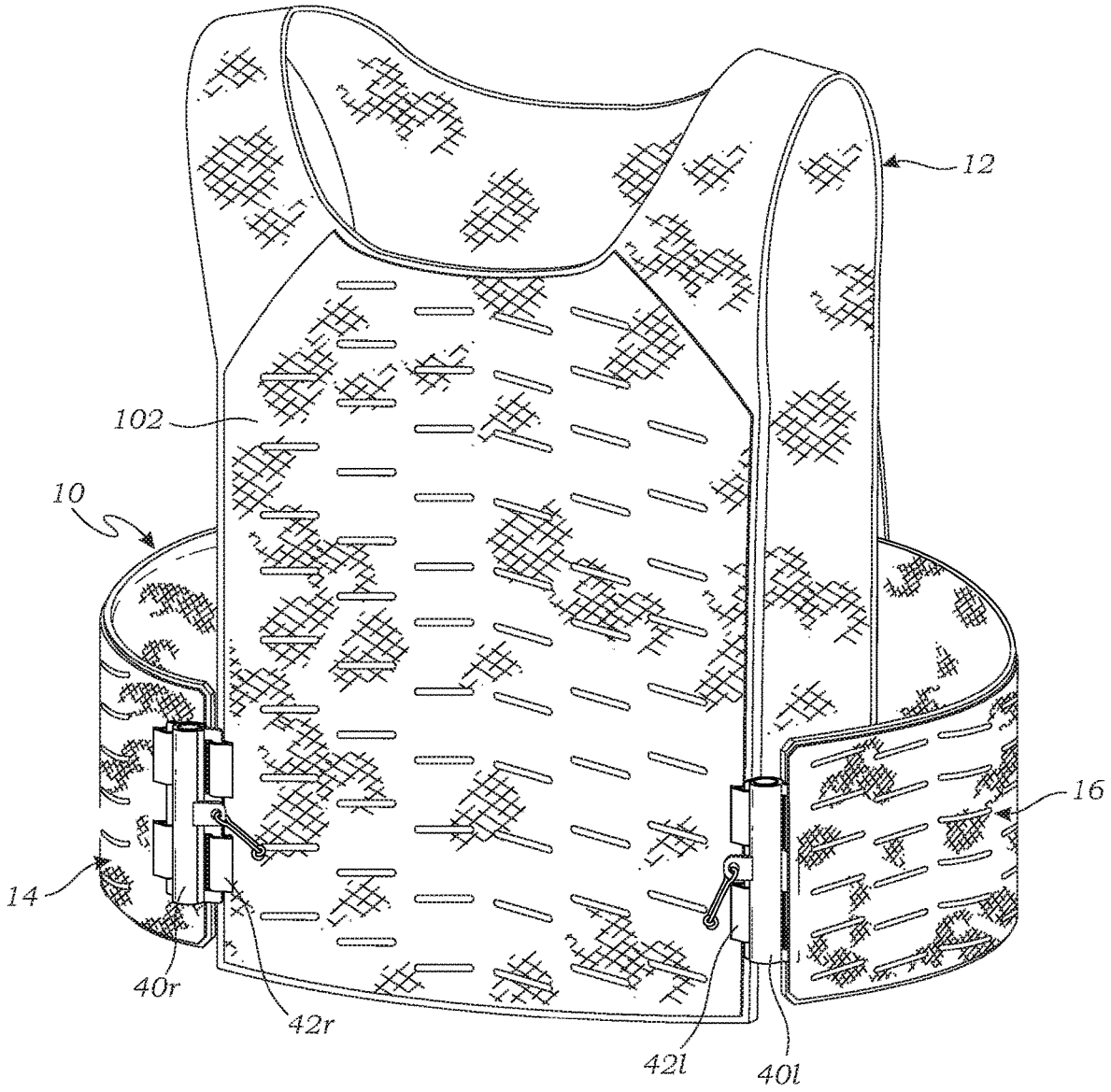
FIG. 10 is front perspective view of the three piece cummerbund of FIG. 5 attached to a tactical vest.
Figure 11:
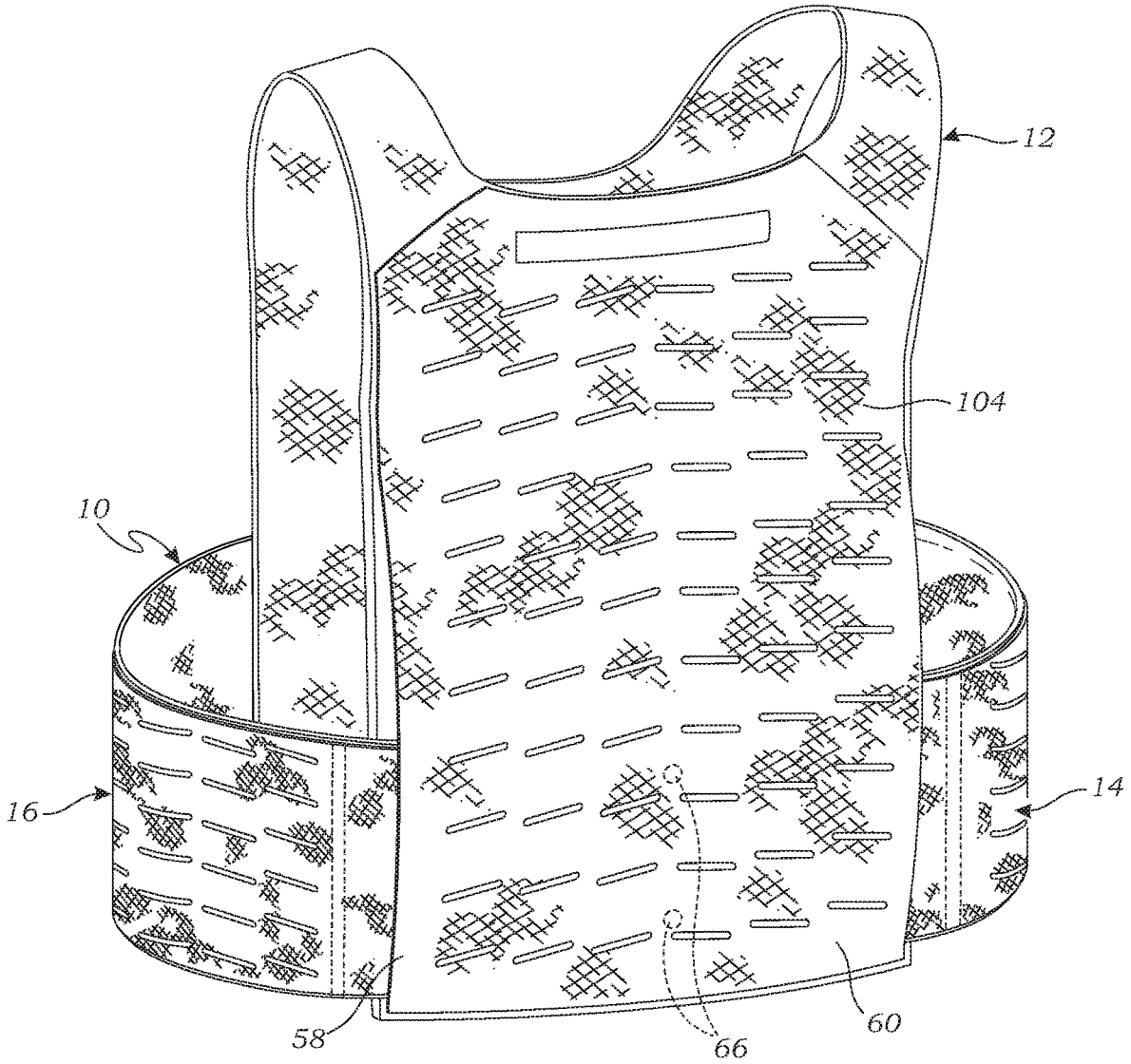
FIG. 11 is rear perspective view of the three piece cummerbund of FIG. 5 attached to a tactical vest.

Referring to FIGS. 5-9, one embodiment of a three piece tactical cummerbund 10 is illustrated. The cummerbund 10 may be configured to be connected to, and used with, a tactical vest 12 as shown in FIGS. 10 and 11. The three main pieces of the cummerbund 10 include a right side portion 14, a left side portion 16, and a connecting band 18. The right side portion 14 and left side portion 16 are protective panels which are positioned over the sides of the wearer when the cummerbund 10 is attached to the tactical vest 14, and the vest 14 and cummerbund 10 are worn by the wearer. The connecting band 18 connects the right side portion 14 and left side portion 16 to each other and is located at the back of the wearer when worn.

Figure 1:
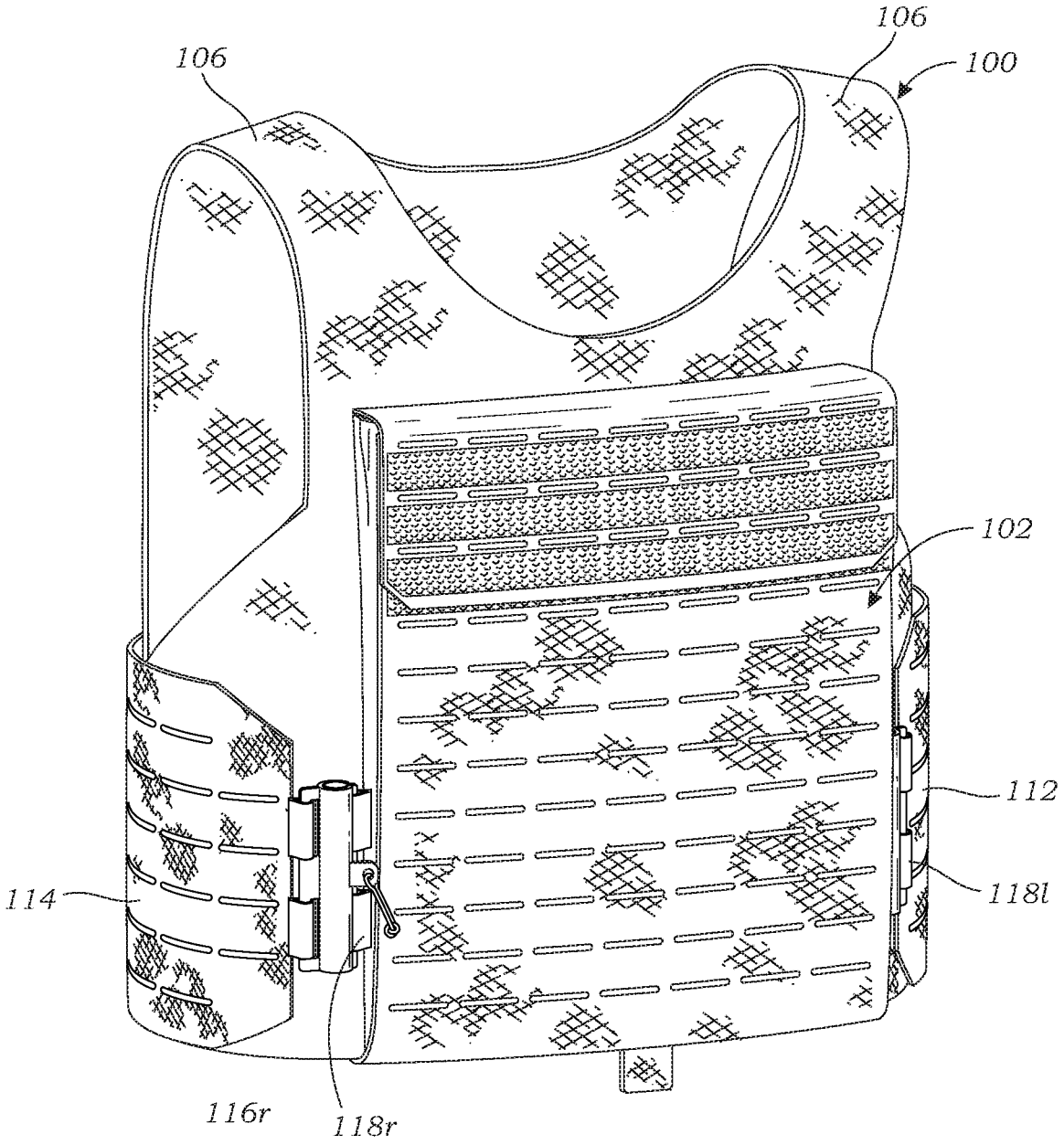
Fig. 1 (Prior Art)
FIG. 1 is a front perspective view of a prior art tactical vest and tactical cummerbund.
Figure 2:
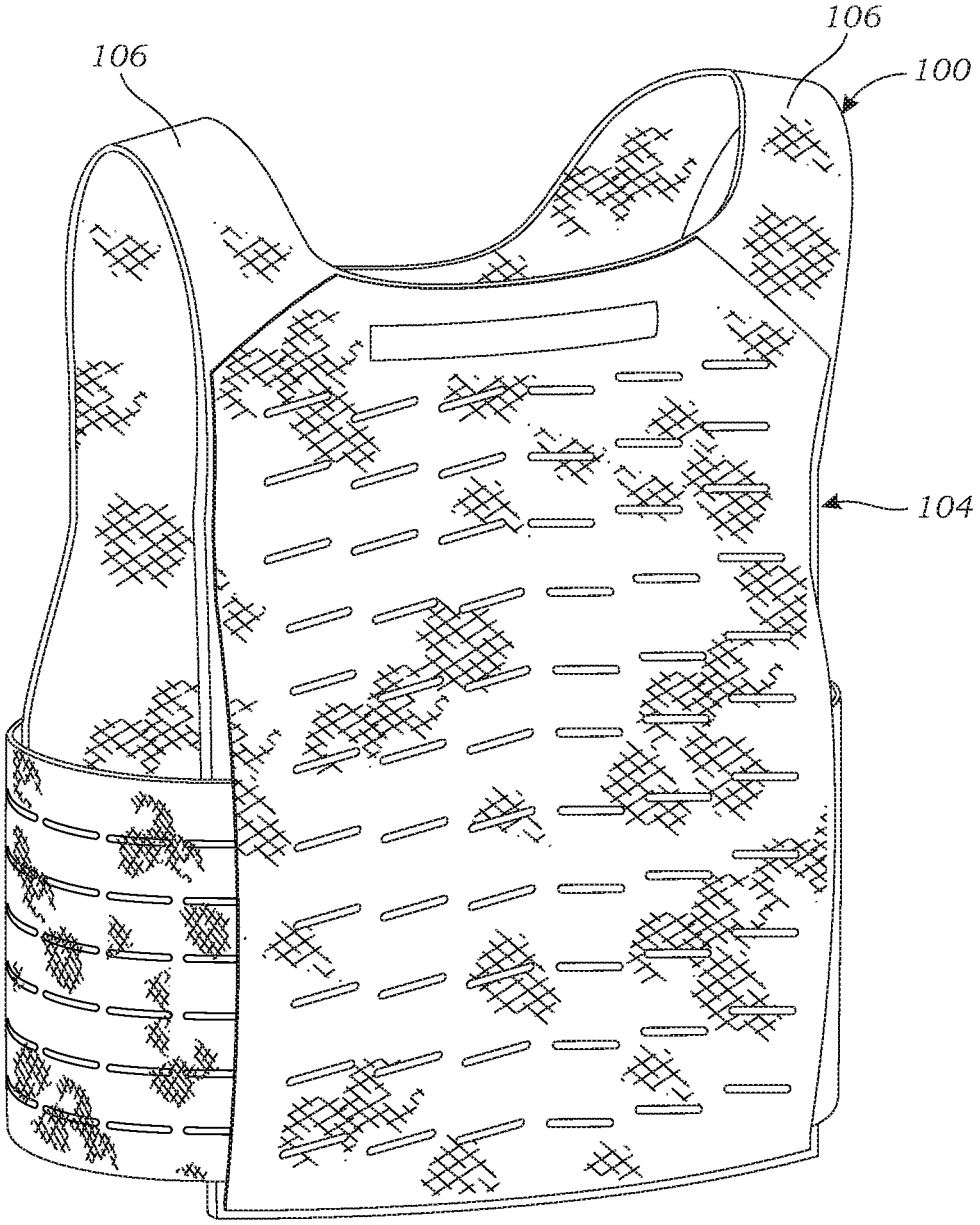
Fig. 2 (Prior Art)
FIG. 2 is a rear perspective view of the prior art tactical vest and tactical cummerbund of FIG. 1.
Figure 3:
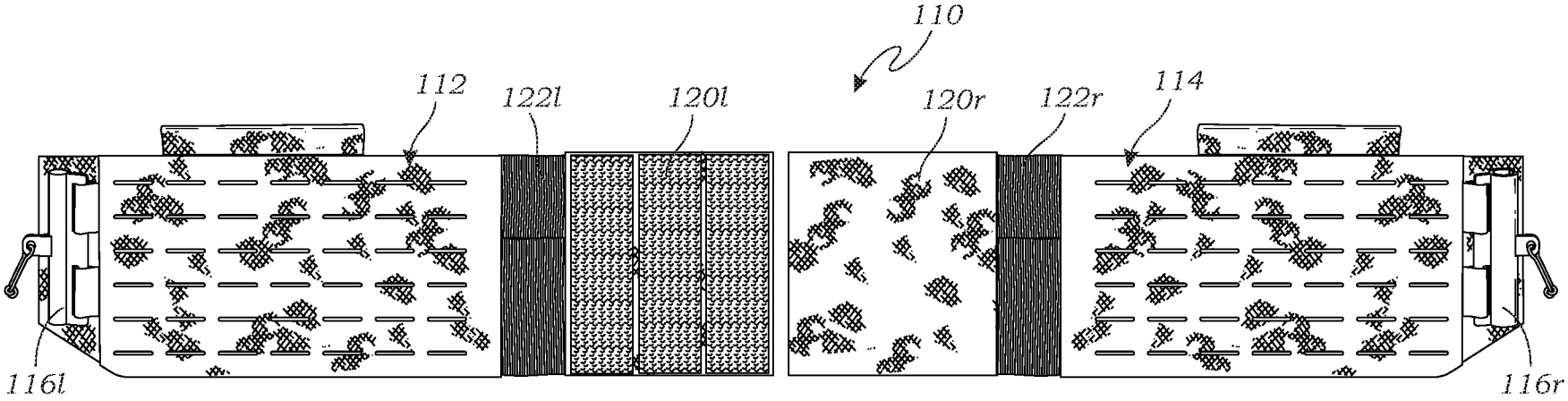
Fig. 3 (Prior Art)
FIG. 3 is a front disassembled view of the prior art tactical cummerbund of FIG. 1.
Figure 4:
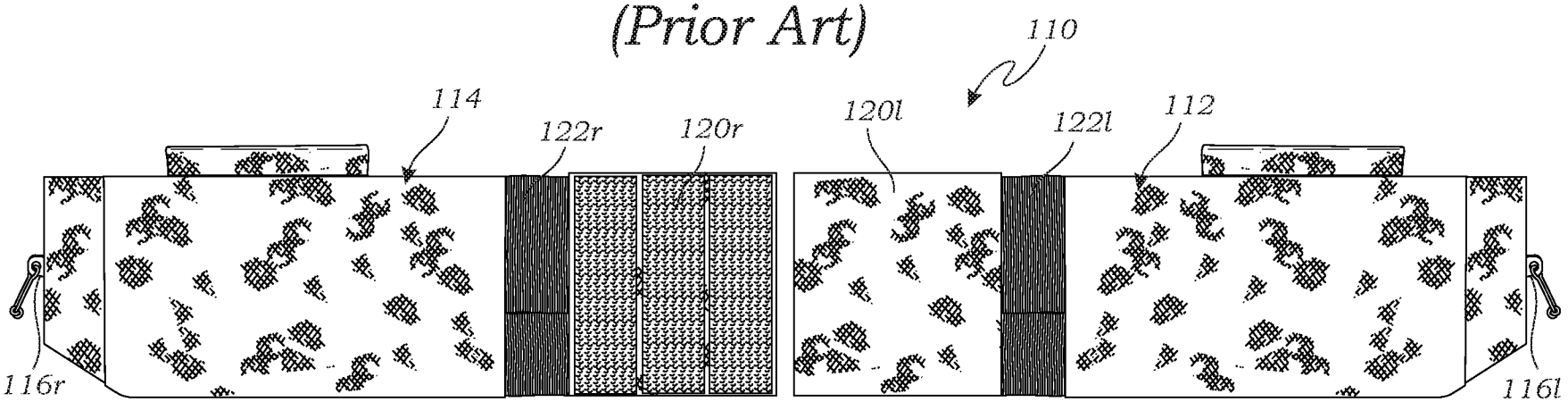
Fig. 4 (Prior Art)
FIG. 4 is a rear disassembled view of the prior art tactical cummerbund of FIG. 1.
Figure 5:
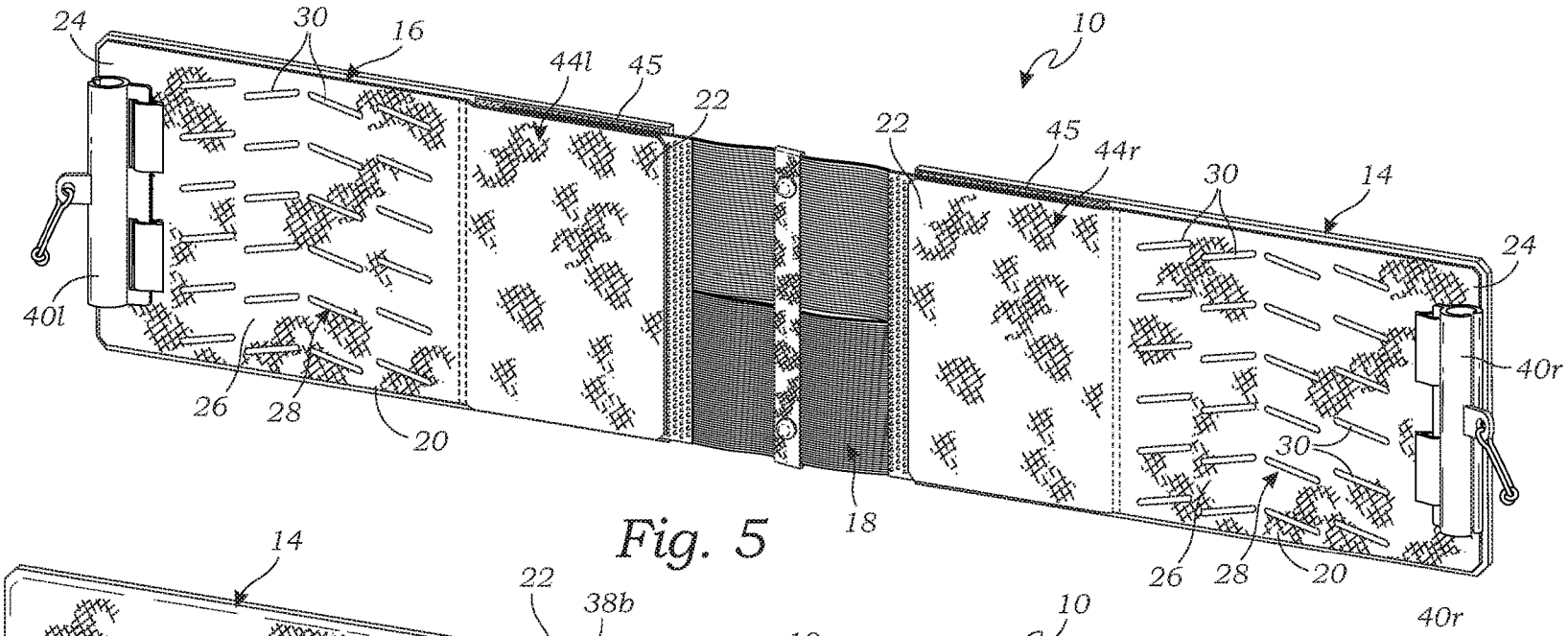
FIG. 5 is a front perspective view of a three piece tactical cummerbund, according to one embodiment of the present invention.
Figure 6:
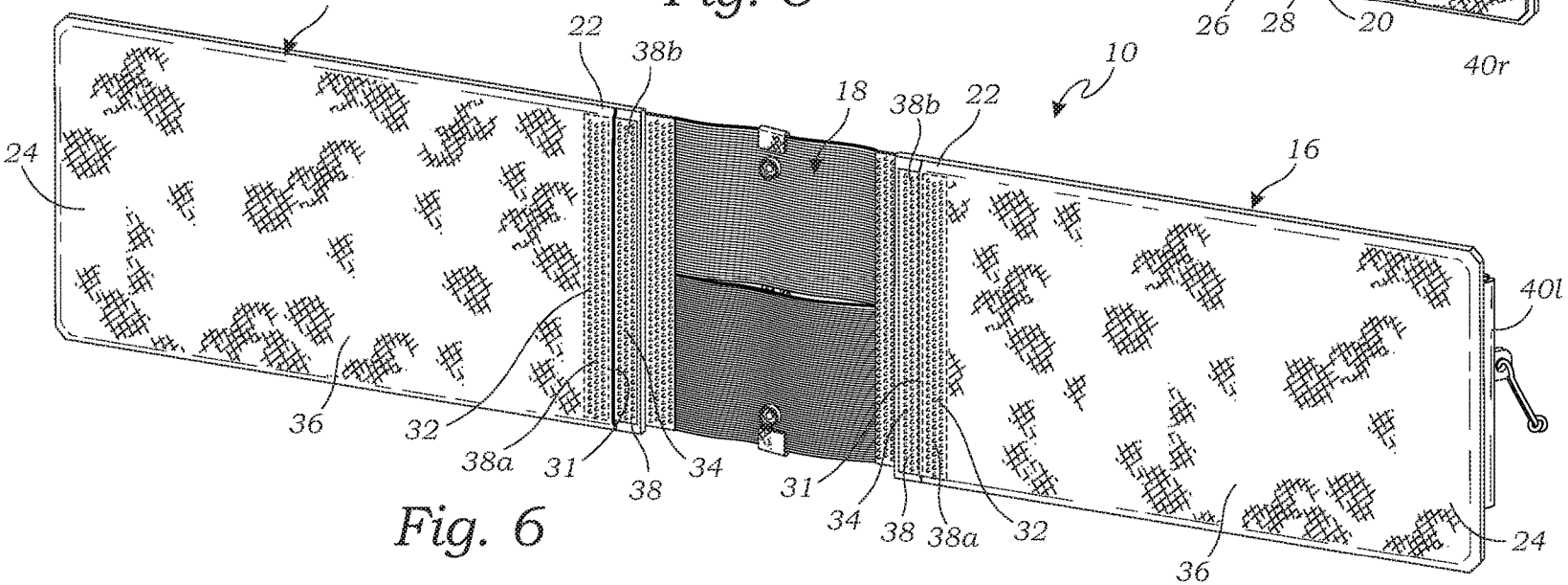
FIG. 6 is a rear perspective view of the three piece tactical cummerbund of FIG. 5, according to one embodiment of the present invention.
Figure 7:
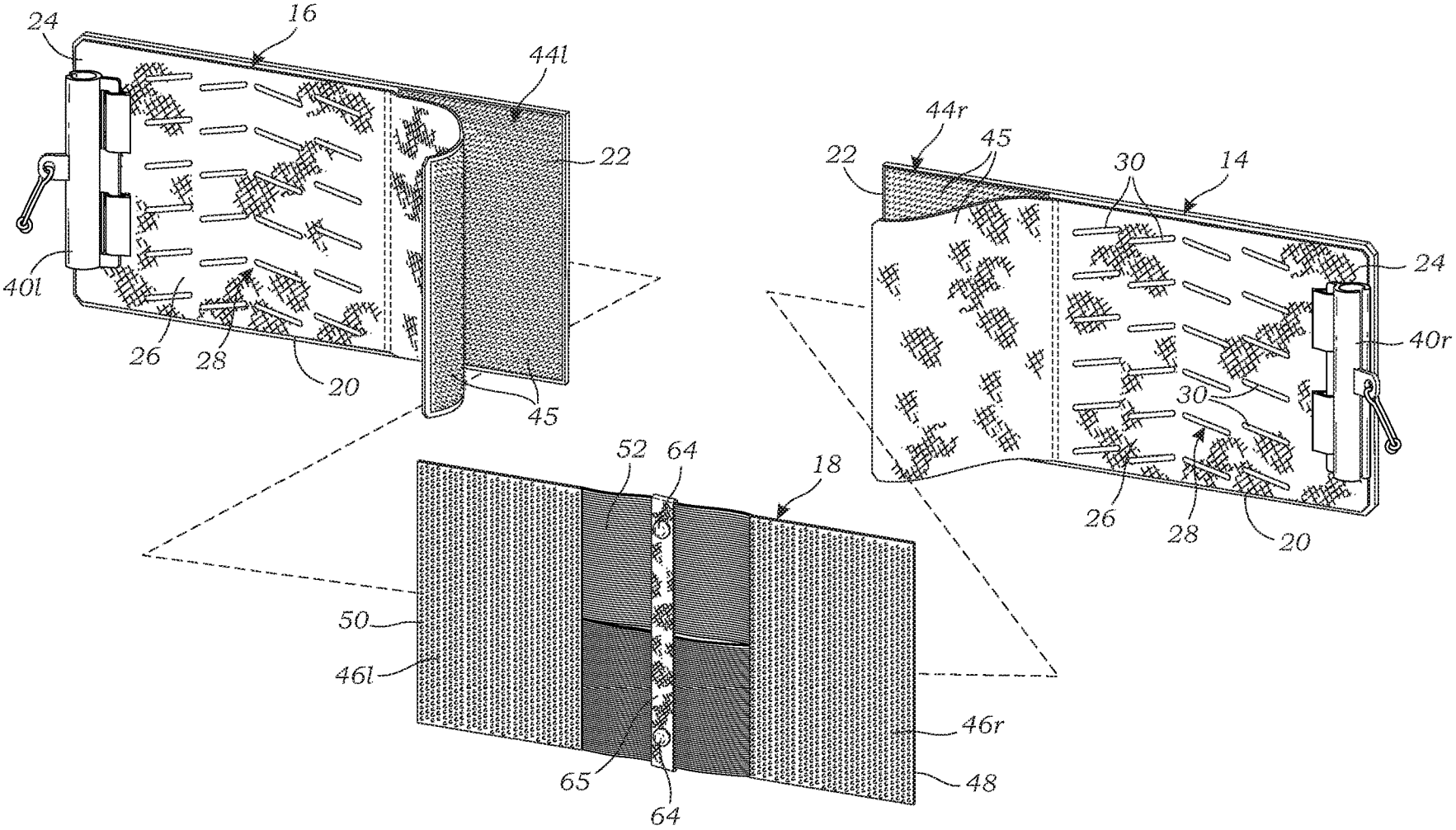
FIG. 7 is a front perspective disassembled view of the three piece cummerbund of FIG. 5, according to one embodiment of the present invention.
Figure 8:
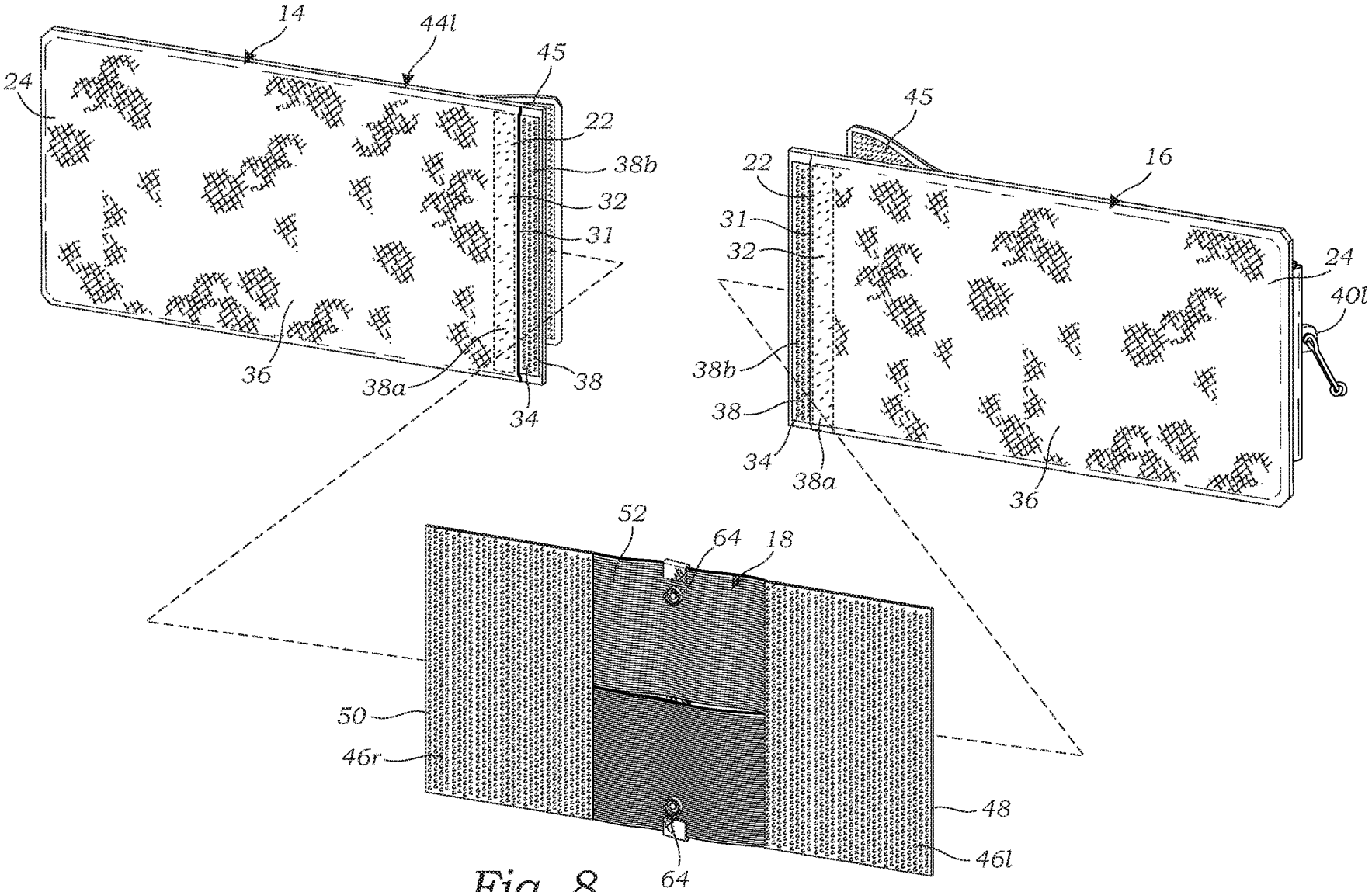
FIG. 8 is a rear perspective disassembled view of the three piece cummerbund of FIG. 5, according to one embodiment of the present invention.

The right side portion 14 includes an elongated, rectangular panel 20 which covers the right side waist of a wearer. The right side portion 14 has a back end 22 which is positioned at the back of the wearer and a front end 24 which is positioned at the front of the wearer, when the cummerbund 10 is installed on the wearer. The elongated panel 20 is a protective panel 20 having multiple layers. As best shown in FIGS. 7 and 8, the panel 20 includes an outer layer 26 which is the outermost layer of the right side portion 14. The outer layer 26 may be made out of any suitable fabric, textile, or sheet of material such as a polymer or woven polymer (e.g., Dacron™). The outer layer 26 also has a PALS surface 28 (MOLLE-compatible surface) comprising an array of slots 30 through the outer layer 26. The PALS surface 28 may cover a portion of the outer layer 26, as shown in the illustrated embodiment, or it may cover the entire outer layer 26 (not shown). The outer layer 26 is attached to an armor pocket 32 such that the inside surface of the outer layer 26 faces and bears against an outside surface of the armor pocket 32. The armor pocket 32 is formed by two sheets of material, an outer pocket layer 34 and an inner pocket layer 36, fixed to each other around three sides of their perimeter, and not fixed on one side, thereby forming a pocket opening 31 into the armor pocket 32. The pocket opening 31 has a pocket closure 38 to close the pocket opening 31. The pocket closure 38 comprises complementary hook and loop fasteners **38*a* and 38*b* attached to the outer pocket layer 34 and inner pocket layer 36, respectively. Alternatively, the pocket closure 38 may be snaps, buttons, a zipper, or other suitable fastener(s). In the illustrated embodiment, the pocket opening 31 is the side of the armor pocket 28 at the back end of the right side portion 14, but it is understood that the armor pocket 32 can be located along any suitable side of the right side portion 14. The right side portion 14, including the panel 20**, may be flexible so that it can curve around the contour of the side of the wearer's waist.

Figure 9:
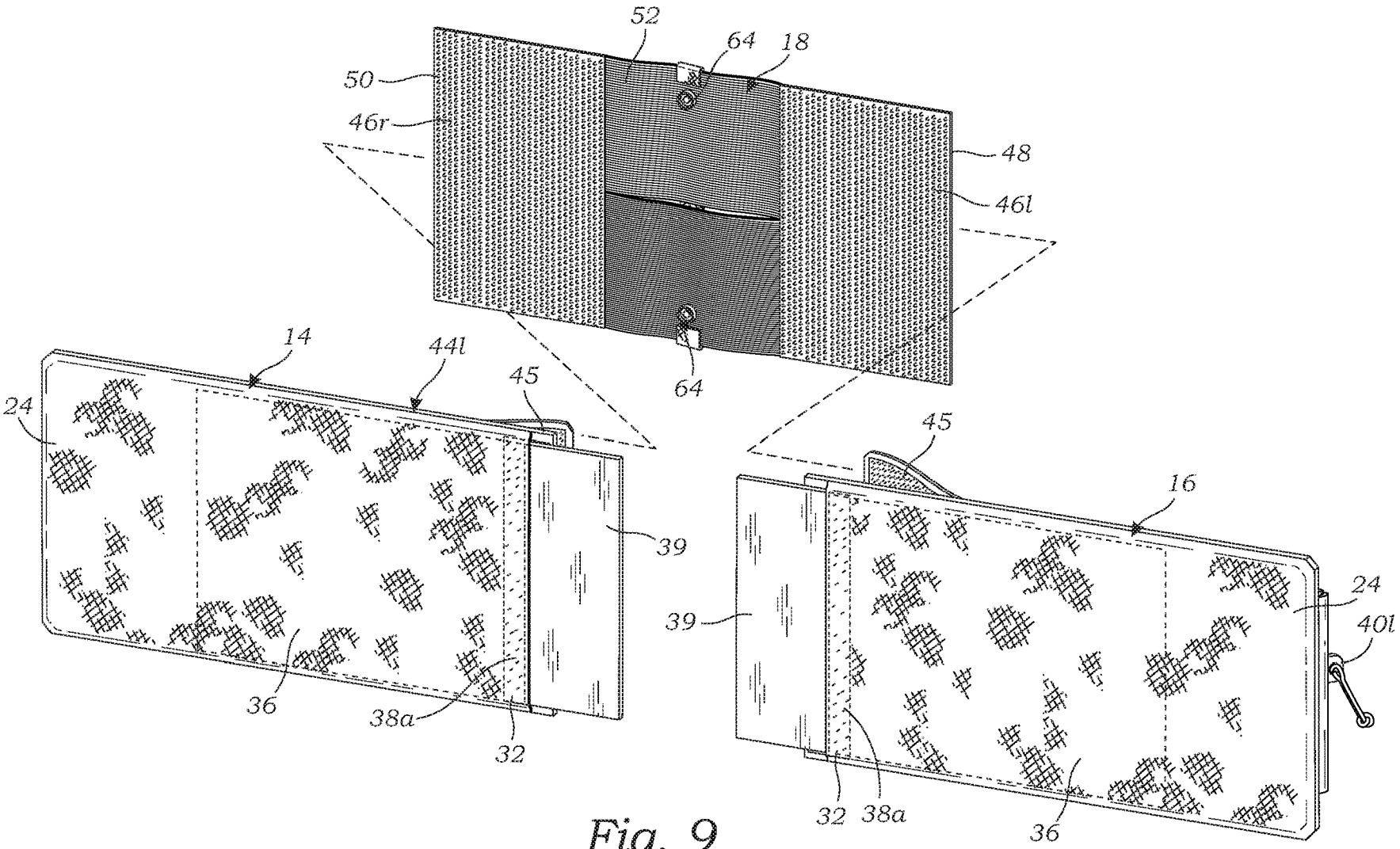
FIG. 9 is a rear perspective disassembled view of the three piece cummerbund of FIG. 5 showing ballistic panels inserted into the pockets of the right side portion and left side portion, according to one embodiment of the present invention.

As depicted in FIG. 9, a ballistic panel 39 is inserted into the armor pocket 32. The ballistic panel 39 may be soft armor which is flexible, or a rigid armor plate, depending on the particular application for the cummerbund 10. For example, soft armor would typically be used by law enforcement, body guards, firefighters, paramedics, search and rescue personnel, and security guards, while armor plate would be more often be used in military applications.

The right side portion 14 has a front right connector **40*r* disposed on the front end 24 of the panel 20. In the illustrated embodiment, the front right connector 40*r* is attached to the outer layer 26 at the front end 24 of the right side portion 14. The front right connector 40*r* releasably connects to a right, front vest connector 42*r* (see FIG. 10). The front right connector 40*r*** is shown as a TUBES™ connector, but may also be any other suitable connector, such as a MOLLE-compatible connector, snaps, zipper, buttons, etc.

The right side portion 14 also has a rear right connector 44*r* disposed on the back end 22 of the panel 20. In the illustrated embodiment, the rear right connector 44*r* comprises an alligator style hook and loop fastener 45. As used herein, the term "alligator style hook and loop fastener" means a hook and loop fastener (i.e., either the hook side or the loop side) in which the hooks or loops are on two opposing surfaces which bear against and sandwich opposite sides of an attaching flap having complementary hooks or loops on both sides of the attaching flap. The rear right connector 44*r* releasably connects to a right connector 46*r* (the attaching flap 46*r*) of the connecting band 18 such that the right side portion 14 extends from a right end 48 of the connecting band 18. The rear right connector 44*r* has the two opposing surfaces having hooks or loops, and the right connector 46*r* of the connecting band 18 has the attaching flap 46*r*.

The left side portion 16 is a mirror image of the right side portion 14, and includes all of the same features of the right side portion 14. Thus, the left side portion 16 includes an elongated, rectangular panel 20 which covers the left side waist of a wearer. The left side portion 16 has a back end 22 which is positioned at the back of the wearer and a front end 24 which is positioned at the front of the wearer, when the cummerbund 10 is installed on the wearer. The elongated panel 20 is a protective panel 20 having multiple layers. As best shown in FIGS. 7 and 8, the panel 20 includes an outer layer 26 which is the outermost layer of the left side portion 16. The outer layer 26 may be made out of any suitable fabric, textile, or sheet of material such as a polymer or woven polymer (e.g., Dacron™). The outer layer 26 also has a PALS surface 28 (MOLLE-compatible surface) comprising an array of slots 30 through the outer layer 26. The PALS surface 28 may cover a portion of the outer layer 26, as shown in the illustrated embodiment, or it may cover the entire outer layer 26 (not shown). The outer layer 26 is attached to an armor pocket 32 such that the inside surface of the outer layer 26 faces and bears against an outside surface of the armor pocket 32. The armor pocket 32 is formed by two sheets of material, an outer pocket layer 34 and an inner pocket layer 36, fixed to each other around three sides of their perimeter, and not fixed on one side, thereby forming a pocket opening 31 into the armor pocket 32. The pocket opening 31 has a pocket closure 38 to close the pocket opening 31. The pocket closure 38 comprises complementary hook and loop fasteners 38*a* and 38*b* attached to the outer pocket layer 34 and inner pocket layer 36, respectively. Alternatively, the pocket closure 38 may be snaps, buttons, a zipper, or other suitable fastener(s). In the illustrated embodiment, the pocket opening 31 is the side of the armor pocket 32 at the back end of the left side portion 14, but it is understood that the armor pocket 32 can be located along any suitable side of the left side portion 16. The left side portion 16, including the panel 20, may be flexible so that it can curve around the contour of the side of the wearer's waist.

As depicted in FIG. 9, a ballistic panel 38 is inserted into the armor pocket 32 of the left side portion 16. The ballistic panel 38 may be soft armor which is flexible, or a rigid armor plate, depending on the particular application for the cummerbund 10.

The left side portion 16 has a front left connector 401 disposed on the front end 24 of the panel 20. In the illustrated embodiment, the front left connector 401 is attached to the outer layer 26 at the front end 24 of the left side portion 14. The front left connector 401 releasably connects to a left, front vest connector 421 (see FIG. 10). The front left connector 401 is shown as a TUBES™ connector, but may also be any other suitable connector, such as a MOLLE-compatible connector, snaps, zipper, buttons, etc.

The left side portion 16 also has a rear left connector 44*l* disposed on the back end 22 of the panel 20. In the illustrated embodiment, the rear left connector 44*l* comprises an alligator style hook and loop fastener 45. The rear left connector 44*l* releasably connects to a left connector 46*l* (the attaching flap 46*l*) of the connecting band 18 such that the left side portion extends from a left end 50 of the connecting band 18. The rear left connector 44*l* has the two opposing surfaces having hooks or loops, and the left connector 46*l* of the connecting band 18 has the attaching flap 46*l*.

The connecting band 18 comprises an elastic band 52 having a right end 48 and a left end 50. The elastic band 52 may comprise one or more elastic bands. For instance, the illustrated embodiment shows the elastic band 52 having two elastic bands extending laterally in parallel. The right connector 46*r* is disposed on the right end 48 of the elastic band 52 and the left connector 46*l* is disposed on the left end 50 of the elastic band 52, such that the elastic band 52 is between the right connector 46*r* and left connector 46*l*. In this way, the elastic band 52 is positioned in the middle of the cummerbund 10 when assembled and worn by a wearer. The right and left connectors 46*r*, 46*l* may be any suitable connector which is complementary to mating connectors 44*r*, 44*l*, respectively, on the back ends of the right side portion 14 and left side portion 16, such as hook and loop fasteners, snaps, Molle-compatible straps, etc., so long as the connection between the mating connectors is adjustable to adjust the overall girth of the cummerbund 10.

The connecting band 18 also has center connectors 64 vertically spaced apart, and laterally centered between the right end 48 and left end 50 of the connecting band. The center connectors 64 connect to mating rear vest connector(s) 66 positioned in the center of the back panel of the vest 12 (i.e., positioned horizontally in the center of the back panel in the left to right direction). The center connectors 64 and mating rear vest connectors 66 hold the cummerbund 10 in place on the vest 12 (i.e., they keep the cummerbund 10 from rotating relative to the vest 12) and also to assist in centering the cummerbund 10 on the tactical vest 12. The center connectors 66 may be attached to a reinforcing strap 65 of the connecting band 18.

As illustrated in FIGS. 10 and 11, the cummerbund 10 connects to the tactical vest 12. The cummerbund 10 is installed on the tactical vest 12 by connecting the rear right connector 44*r* to the right connector 46*r* of the connecting band 18, connecting the rear left connector 44*l* to the left connector 46*l* of the connecting band 18, and inserting the cummerbund 10 through the channel 58 of the rear panel 60 of the tactical vest 12 until the connecting band 18 is centered within the channel 58 and/or the center connector(s) 64 are aligned with mating rear vest connector(s) 66 in the channel 58. The center connector(s) 64 are connected to the rear vest connector(s) 66 which centers the cummerbund 10 on the tactical vest 12, and fixes the cummerbund 10 to the vest 12. At this point, with the cummerbund 10 disconnected at the front, a wearer puts on the vest 12 and cummerbund 10, with the shoulder straps of the vest on the shoulders of the wearer. Then, the front right connector 40*r* is connected to the right, front vest connector 42*r* and the front left connector 40*l* is connected to the left, front vest connector 42*l*, which closes the cummerbund 10 onto the vest 12.

In order to properly adjust the girth of the cummerbund 10 (i.e., the overall length of the cummerbund 10) for a particular wearer, the tactical vest 12 is first put onto the wearer. The front closure ends of the cummerbund 10 are connected to the tactical vest 12 by connecting the front right connector 40*r* to the right, front vest connector 42*r* and connecting the front left connector 401 to the left, front vest connector 421, with the rear right connector 44*r* not connected to the right connector 46*r* of the connecting band 18, and the rear left connector 44*l* not connected to the left connector 46*l* of the connecting band 18. The rear ends of the right side portion 14 and left side portion 16 are positioned at the back of the vest 12 over the back panel of the vest 12. The connecting band 18 is centered on the back panel of the vest 12, and the rear right connector 44*r* is connected to the right connector 46*r* of the connecting band 18, and the rear left connector 44*l* is connected to the left connector 46*l* of the connecting band 18, such that the cummerbund 10 fits properly around the waist of the wearer. The cummerbund 10 is then removed by disconnecting the right connector 40*r* from the right, front vest connector 42*r* and disconnecting the front left connector 40*l* from the left, front vest connector 421. The girth of the cummerbund 10 is now properly adjusted for the wearer, and can be donned by the wearer as described above.

In order to fit wearers of different sizes (e.g., different waist dimensions), the right side portion 14 and left side portion 16 may come in a variety of sizes. The different sizes of right side portion 14 and left side portion 16 may have different lengths (i.e., to fit different waist dimensions). For instance, the cummerbund 10 may come in small, medium, large, extra large, etc., each having different lengths for the right side portion 14 and left side portion 16. Nevertheless, the connecting band 18 may be a standard length usable with all of the different sizes of cummerbunds 10. Thus, this simplifies the replacement of the connecting band 18, because it is "one size fits all."

Accordingly, a three piece tactical cummerbund 10 is provided which has significant advantages over previous two piece cummerbund designs. The three piece cummerbund 10 is easy to center when installing the cummerbund 10 by simply attaching the right side portion 14 and left side portion 16 to the connecting band 18, positioning the connecting band 18 in the center of the rear panel of the tactical vest 12 (e.g., by connecting the center connector(s) 64 to rear vest connector(s) 66), attaching the front right connector 40*r* to the right, front vest connector 42*r*, and attaching the front left connector 40*l* to the left, front vest connector 42*l*.

Moreover, the elastic band 52 of the connecting band 18 is positioned in the middle of the cummerbund 10, between the connections to the right side portion 14 and left side portion 16. As shown in FIG. 11, when the back of the cummerbund 10 is inserted into the channel 58 of the rear panel 60 of the tactical vest 10, the elastic band 52 is centered within the channel 58 such that it is completely enclosed and protected within the channel 58. Therefore, the elastic band 52 is protected from the elements, and will last longer than the elastic bands of prior two piece cummerbund designs.

Furthermore, when the elastic band 52 of the connecting band 18 wears out, or otherwise needs replacing, only the connecting band 18 of the cummerbund 10 must be replaced. The protective portions of the cummerbund 10, including the right side portion 14 and left side portion 16, do not need to be replaced when elastic band 18 needs replacing.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A tactical cummerbund for connection to, and use with, a tactical vest, the tactical vest having a front panel and a rear panel, the front panel having a right, front vest connector and a left, front vest connector, the rear panel having a rear channel extending horizontally through the rear panel and having a horizontal length, the cummerbund comprising:

a connecting band comprising an elastic band having a right end and a left end, a right hook and loop fastener disposed on the right end of the elastic band, and a left hook and loop fastener disposed on the left end of the elastic band such that the elastic band is between the right hook and loop fastener and left hook and loop fastener, the connecting band configured to be located within the rear channel, and a length of the connecting band between the right hook and loop fastener and the left hook and loop fastener is less than the length of the rear channel such that the connecting band is entirely concealed within the rear channel when the cummerbund is installed on the tactical vest;

a right side portion comprising an elongated panel, the panel having a pocket covering substantially the entire area of the panel for inserting ballistic armor, the right side portion having a first end and a second end, a front right connector disposed on the first end of the right side portion overlying the pocket and a right, rear hook and loop fastener disposed on the second end of the right side portion overlying the pocket, the front right connector configured to releasably connect to the right, front vest connector and the right, rear hook and loop fastener configured to releasably connect to the right hook and loop fastener of the connecting band; and a left side portion comprising an elongated panel, the panel having a pocket covering substantially the entire area of the panel for inserting ballistic armor, the left side portion having a first end and a second end, a front left connector disposed on the first end of the left side portion and a left, rear hook and loop fastener disposed on the second end of the left side portion, the front left connector configured to releasably connect to the left, front vest connector and the left, rear hook and loop fastener configured to releasably connect to the left hook and loop fastener of the connecting band.

2. The tactical cummerbund of claim 1, wherein the right hook and loop fastener of the connecting band extends away from the right end of the elastic band, and the left hook and loop fastener of the connecting band extends away from the left end of the elastic band, such that the right side portion overlaps the connecting band when the right hook and loop fastener of the connecting band is connected to the right, rear hook and loop fastener of the right side portion, and the left side portion overlaps the connecting band when the left hook and loop fastener of the connecting band is connected to the left, rear hook and loop fastener of the left side portion.

3. The tactical cummerbund of claim 1, wherein the connection between the right hook and loop fastener of the connecting band and the right, rear hook and loop fastener is adjustable to adjust the overall length of the cummerbund, and the connection between the left hook and loop and fastener of the connecting band and the left, rear hook and loop fastener of the left side portion is adjustable to adjust the overall length of the cummerbund.

4. The tactical cummerbund of claim 1, wherein the connecting band has a center connector disposed on the elastic band equidistant from the left end and the right end of the connecting band, the center connector configured to releasably connect to a rear vest connector located in the middle of the rear channel in the left to right direction.

5. The tactical cummerbund of claim 1, wherein:

the panel of the right side portion includes a pocket covering substantially the entire area of the panel for inserting ballistic armor; and the panel of the left side portion includes a pocket covering substantially the entire area of the panel for inserting ballistic armor.

6. The tactical cummerbund of claim 5, further comprising:

a right ballistic panel inserted into the pocket of the panel of the right side portion; and a left ballistic panel inserted into the pocket of the panel of the left side portion.

7. The tactical cummerbund of claim 6, wherein the right ballistic panel and left ballistic panel comprise soft armor.

8. The tactical cummerbund of claim 6, wherein the right ballistic panel and left ballistic panel comprise plated armor.

9. The tactical cummerbund of claim 1, wherein:

an outside cover of the right side portion has a PALS surface; and an outside cover of the left side portion has a PALS surface.

10. The tactical cummerbund of claim 1, wherein:

the right, front vest connector and front right connector are complementary tube-style connectors; and the left, front vest connector and front left connector are complementary tube-style connectors.

11. The tactical cummerbund of claim 1, wherein:

the right hook and loop fastener of the connecting band and the right, rear hook and loop fastener comprise a complementary alligator style hook and loop fastener; and the left hook and loop fastener of the connecting band and the left, rear hook and loops fastener comprise a complementary alligator style hook and loop fastener;

the right, front vest connector and front right connector are complementary tube-style connectors; and the left, front vest connector and front left connector are complementary tube-style connectors.

12. A tactical garment, comprising a tactical vest having a front panel and a rear panel, the front panel having a right, front vest connector and a left, front vest connector, the rear panel having a rear channel extending horizontally through the rear panel and having a horizontal length; and a cummerbund connecting the front panel to the rear panel, the cummerbund comprising:

a connecting band comprising an elastic band having a right end and a left end, a right connector disposed on the right end of the elastic band and a left connector disposed on the left end of the elastic band such that the elastic band is circumferentially between the left connector and the right connector;

a right side portion comprising an elongated panel, the right side portion having a first end and a second end, a front right connector disposed on the first end of the right side portion and a rear right connector disposed on the second end of the right side portion, the front right connector releasably connected to the right, front vest connector and the rear right connector releasably connected to the right connector of the connecting band; and a left side portion comprising an elongated panel, the left side portion having a first end and a second end, a front left connector disposed on the first end of the left side portion and a rear left connector disposed on the second end of the left side portion, the front left connector releasably connect to the left, front vest connector and the rear left connector releasably connected to the left connector of the connecting band;

wherein the cummerbund extends through the rear channel of the of the rear panel such that the elastic band is completely enclosed within the rear channel.

13. The tactical garment of claim 12, wherein the connection between the right connector of the connecting band and the rear right connector of the right side portion is adjustable to adjust an overall length of the cummerbund, and the connection between the left connector of the connecting band and the rear left connector of the left side portion is adjustable to adjust an overall length of the cummerbund.

14. The tactical garment of claim 13, wherein:

the right connector of the connecting band and the rear right connector comprise a complementary alligator style hook and loop fastener;

the left connector of the connecting band and the rear left connector comprise a complementary alligator style hook and loop fastener;

the right, front vest connector and front right connector comprise complementary tube-style connectors; and the left, front vest connector and front left connector comprise complementary tube-style connectors.

15. The tactical garment of claim 13, wherein the right connector of the elastic band and the rear right connector are complementary hook and loop fasteners, and the left connector of the elastic band and the rear left connector are complementary hook and loop fasteners.

16. The tactical garment of claim 12, wherein:

the tactical vest has a rear vest connector located in the middle of the rear panel in the left to right direction; and the connecting band has a center connector disposed on the elastic band equidistant from the left end and the right end of the connecting band, the center connector configured to releasably connect to the rear vest connector.

17. The tactical garment of claim 12, wherein:

the panel of the right side portion includes a pocket covering substantially the entire area of the panel for inserting ballistic armor; and the panel of the left side portion includes a pocket covering substantially the entire area of the panel for inserting ballistic armor.

18. The tactical garment of claim 17, further comprising:

a right ballistic panel inserted into the pocket of the panel of the right side portion; and a left ballistic panel inserted into the pocket of the panel of the left side portion.

19. The tactical garment of claim 18, wherein the right ballistic panel and left ballistic panel comprise soft armor.

20. The tactical garment of claim 18, wherein the right ballistic panel and left ballistic panel comprise plated armor.

21. The tactical garment of claim 12, wherein:

an outside cover of the right side portion has a PALS surface; and an outside cover of the left side portion has a PALS surface.

22. The tactical garment of claim 12, wherein:

the right connector of the connecting band and the rear right connector comprise complementary hook and loop fasteners;

the left connector of the connecting band and the rear left connector comprise complementary hook and loop fasteners;

the right, front vest connector and front right connector comprise complementary tube-style connectors; and the left, front vest connector and front left connector comprise complementary tube-style connectors.

* * * * *